United States Patent [19]

Kuchenbecker

[11] Patent Number: 4,919,271

[45] Date of Patent: Apr. 24, 1990

[54] CARTON WITH TEAR STRIP

[75] Inventor: Morris W. Kuchenbecker, Neenah, Wis.

[73] Assignee: James River Corporation, Richmond, Va.

[21] Appl. No.: 270,935

[22] Filed: Nov. 14, 1988

[51] Int. Cl.[5] ..... B65D 5/54

[52] U.S. Cl. ..... 206/611; 206/608; 206/629

[58] Field of Search ..... 206/608, 611, 613, 620, 206/629, 631

[56] References Cited

U.S. PATENT DOCUMENTS

| | | | |
|---|---|---|---|
| 2,680,558 | 6/1954 | Mai | 206/613 |
| 3,096,918 | 7/1963 | Van Dyke et al. | 206/613 |
| 3,144,195 | 8/1964 | Hennessey | 206/631 |
| 3,301,391 | 1/1967 | Guyer | 206/629 |
| 3,410,476 | 11/1968 | Buttery | 206/613 |
| 3,524,581 | 8/1968 | Buttery | 206/608 |
| 3,708,104 | 1/1973 | Buttery | 206/608 |
| 3,958,748 | 5/1976 | Smith et al. | 206/629 |
| 4,538,732 | 9/1985 | Kuchenbecker | 206/613 |

*Primary Examiner*—Gary Elkins

*Attorney, Agent, or Firm*—Sixbey, Friedman, Leedom & Ferguson

[57] ABSTRACT

A paperboard carton constructed from an integral paperboard blank has an improved pull tab tear strip opening. The carton contains at least two layers of paperboard in the area where the pull tab tear strip opening feature is located. The pull tab tear strip is an integral part of the outer layer. The pull tab tear strip is bounded along one elongate side by a cut line of weakness having a plurality of through cuts and along a second elongate side by a partial cut score line which facilitates ply separation of the outer panel adjacent this side during carton opening.

17 Claims, 3 Drawing Sheets

CARTON WITH TEAR STRIP

BACKGROUND OF THE INVENTION

The present invention relates to disposable paperboard cartons, more particularly to cartons constructed from a single integral flat blank of paperboard having a pull tab tear strip for easy opening. The tear strip opening feature may be located at either end or side of the container. The cartons are typically used to package, store, ship and sell product at retail for consumer use. The requirements, therefore, are for the carton to be sealed to effect an end panel closure, and should provide ease of opening for gaining access to the contents of the container.

Numerous types of opening features are known in the prior art. U.S. Pat. No. 3,410,476 illustrates opening features similar to the subject invention. This patent discloses a reclosable carton having a tear strip comprised of a plurality of linearly positioned slits provided with continuous cut score lines extending the length of the slits. U.S. Pat. No. 3,524,581 also discloses a tear strip utilizing both a fracture line and a cut score line. Neither patent, however, discloses a tear strip which contains a line of herringbone perforations on one side and a cut score line on the other.

U.S. Pat. No. 4,538,732 discloses a tear strip for use on a relatively narrow side wall of a flat paperboard carton. This tear strip also operates on the principal of ply separation but does not contain an underside cut score line for defining a point of weakness for the beginning of ply separation. The improved feature of this invention provides better, easier, and more predictable separation of the plys.

SUMMARY OF THE INVENTION

This invention relates to an improved easy opening tear feature which is an integral part of a paperboard disposable carton. The carton is typically cut and scored from paperboard and can be coated on one or both sides with various extrusions or laminations. The container is designed to preserve and protect the contents contained therein and to provide an opening feature to allow the purchaser easy access to the contained product. Certain carton constructions provide a reclosable end for reuse. Others are opened, the contents emptied, and the carton disposed of. The carton of the present invention includes an improved pull tab tear opening feature having a cut line of weakness defining one side of the tab with a full length partial cut score line of weakness defining the opposite side to improve and facilitate ply separation in a region between the cut score line and a free edge of end or side wall. The pull tab is constructed such that the tab cut edge intersects the cut score line at an oblique angle relative to the cut score line which initiates the beginning of ply separation at the point of a glued area which is the region between the pull tab and the free edge.

DETAILED DESCRIPTION

Figure 1:
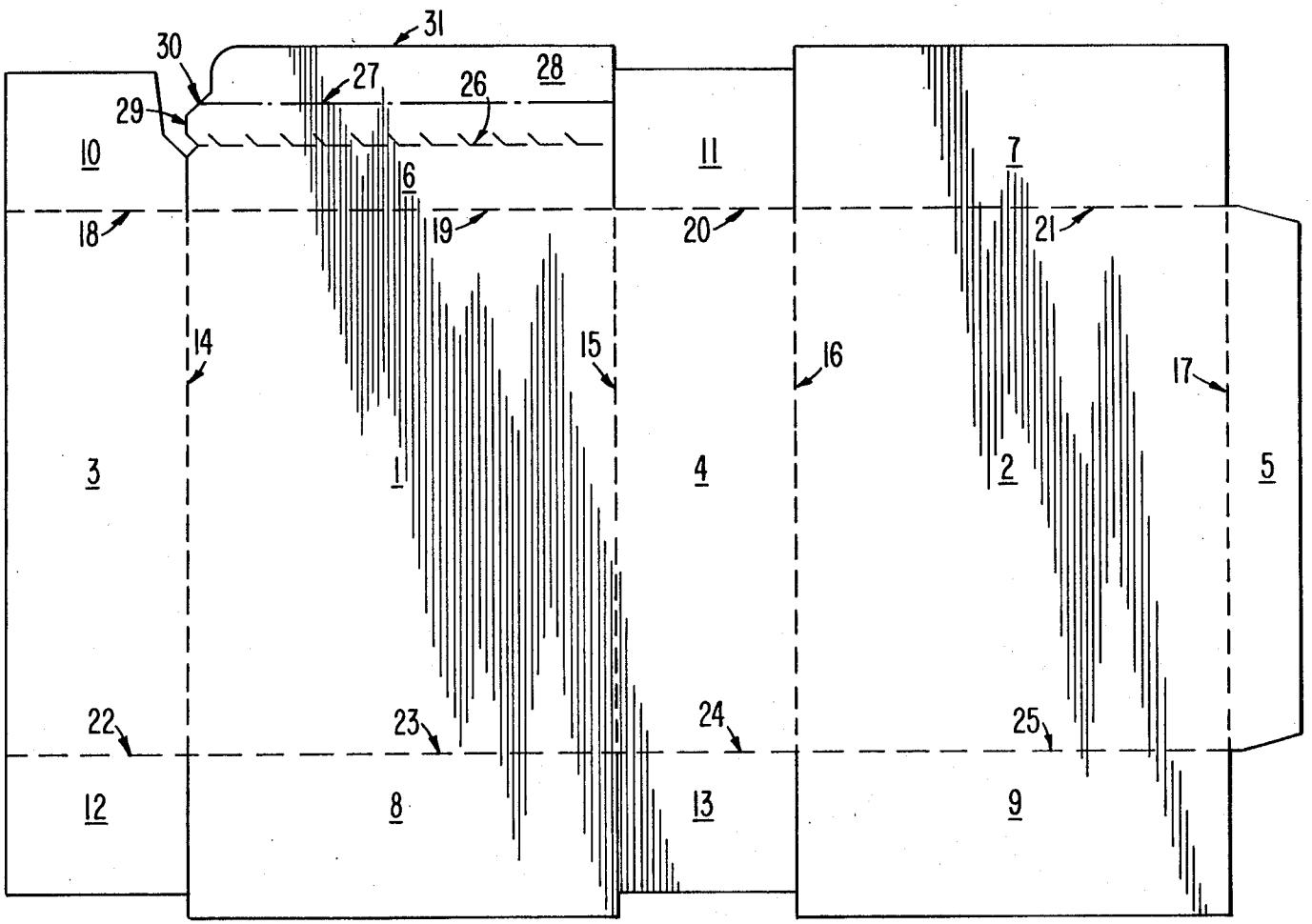
FIG. 1 is a plan view of the inside of the carton blank incorporating a preferred embodiment of the present invention.

Referring to FIG. 1 the carton blank is formed of a paperboard material and includes main body panels 1 and 2, side panels 3 and 4, and a glue flap 5. Additionally, the carton blank has top end panels 6 and 7, bottom end panels 8 and 9, and minor flaps 10, 11, 12 and 13.

The carton main panels 1 and 2 are divided by folding crease score lines 14, 15, 16 and 17. The carton top and bottom end panels 6, 7, 8 and 9 are divided by crease score fold lines 18, 19, 20, 21, 22, 23, 24 and 25.

The top end panel 6 has a plurality of knife cuts forming a line of weakness 26 and an inside partial cut score line 27 forming another line of weakness which is cut to a depth of about 50% of the paperboard thickness. Panel 6 also has an adhesive area 28 defined by a free edge of panel 6 and the partial cut score line 27 that will receive an application of adhesive during the end panel closure at the time of product packaging. The knife cuts are preferably of the herringbone type as shown in the figures.

After printing and die cutting the carton is glued, forming a tubular structure by first applying glue to the outside of glue flap 5. Main panel 2 is then folded on crease score line 16 and side panel 3 is folded on crease score line 14. Side panel 3 will lie on top of glue flap 5, which now completes the manufacture of the carton and in a tubular structure.

After erection and product loading the minor flaps 10, 11, 12 and 13 are folded in, the inside end panels 7 and 9 are then folded up and the outside top and bottom end panels 6 and 8 receive an application of adhesive with the application of adhesive being placed on panel 6 in the adhesive area 28 and folded down to complete the carton closure.

Figure 2:
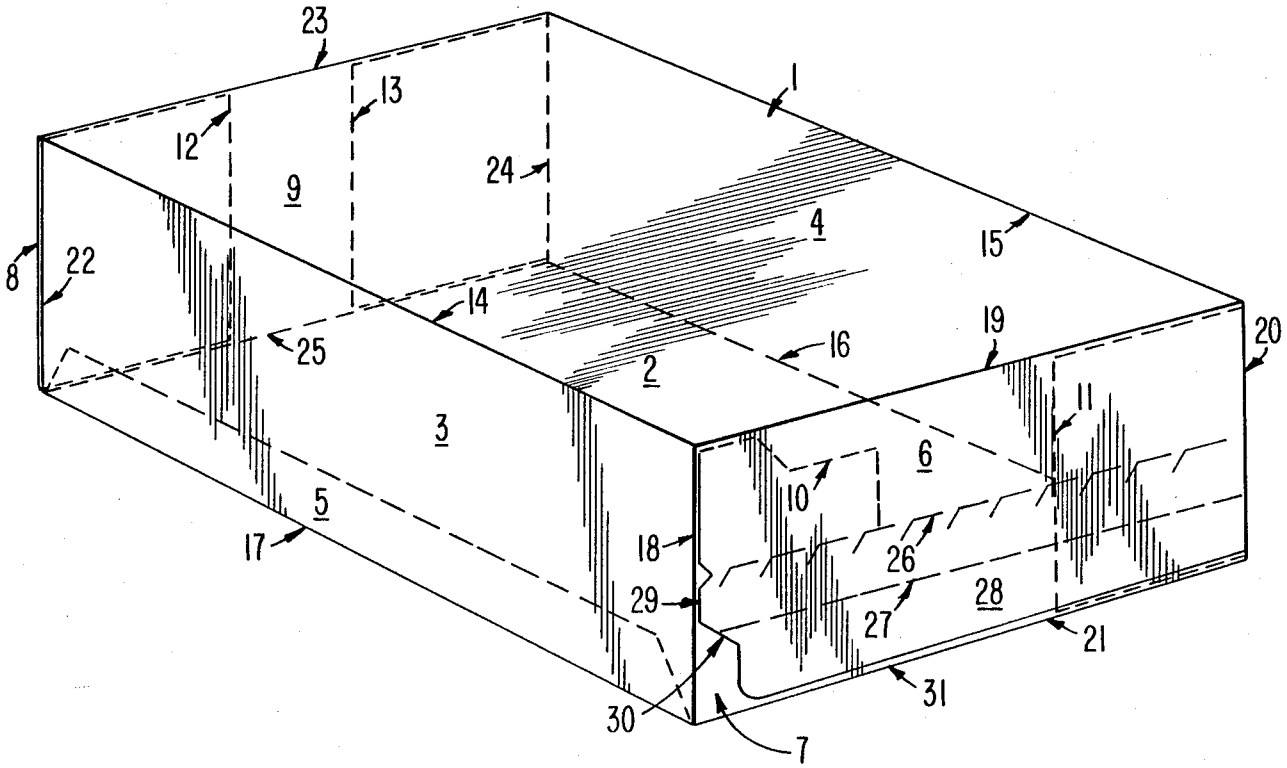
FIG. 2 is a perspective view showing the end of the carton glued and in a set up position.
Figure 3:
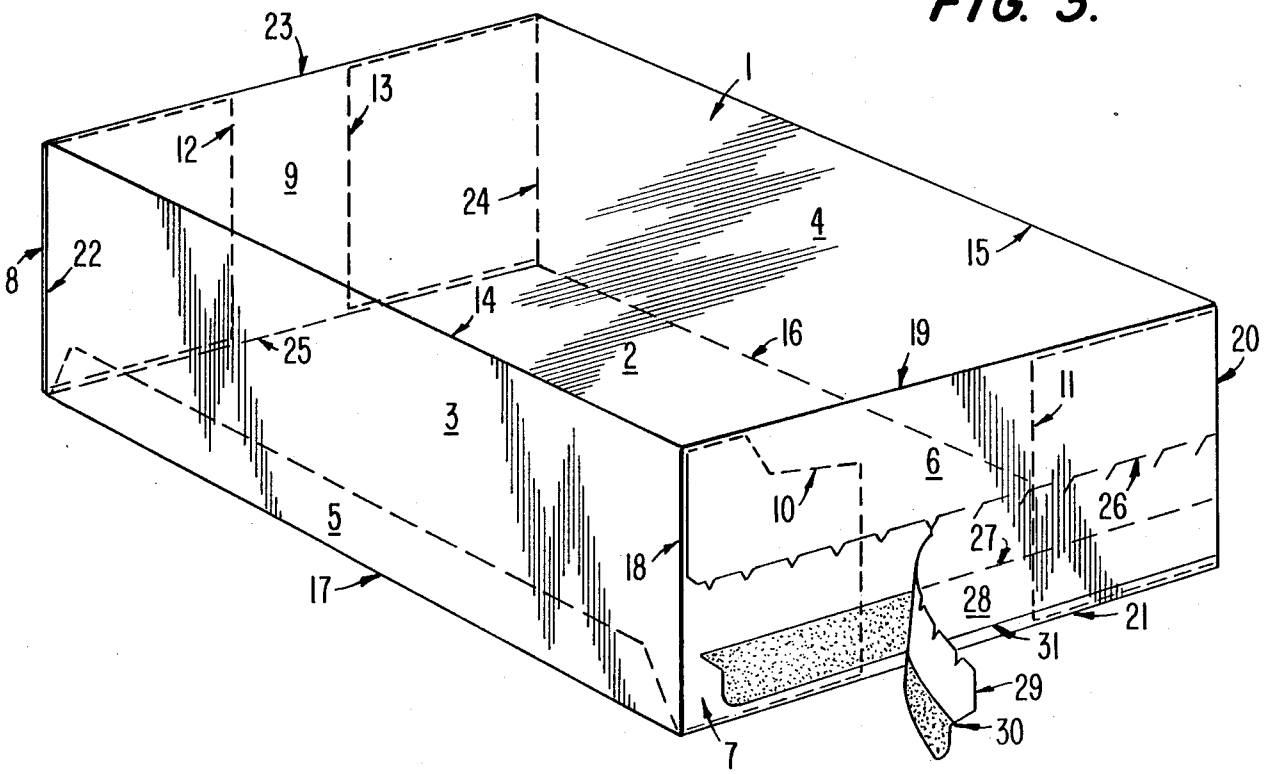
FIG. 3 is a perspective view showing the end of the carton in a set up position and partially opened.

To open the user will grasp the pull tab 29, tearing up and rearwardly, at which time the space between the knife cuts forming the line of weakness 26 will rupture. Due to the inside cut score 27 the paperboard will start to ply separate at the beginning of a sharp point 30 and continue to ply separate and rupture until the tear strip has been completely removed. The sharp point 30 is formed by a diverging edge of the pull tab 29 which intersects partial cut score line 27 and continues beyond line 27 into the region 28 as shown in FIG. 2. Consequently, opening forces will be concentrated at the sharp point 30 for ease in opening the tear strip.

Another embodiment of this invention may omit the sharp point 30; however, it has been proved that the opening of the carton is more consistent and dependable with such a force concentration point. The important feature of this opening feature is the distance between the cut line of weakness 26 and the inside cut score line 27 can be much less than with cartons having an opening feature of two cut lines of the through cut type similar to that of line 26 where the diagonal lines face each other inwardly. This opening feature can, therefore, be used on cartons having narrow end panels.

Another feature of this invention is that the carton formed in accordance with the present invention is stronger than those having two cut lines of weakness. During opening, the area between the cut line of weakness 27 and the die cut edge 31 forms a ply separation which is a continuous and uninterrupted area of paperboard and is not as vulnerable to breaking as often is experienced with tear strips having two cut lines of weakness.

It is to be understood that this invention is not limited to the exact details of construction, operation, or exact materials or embodiments shown and described, as obvious modifications and equivalents will be apparent to one skilled in the art, and the invention is therefore to be limited only by the scope of the appended claims.

What is claimed is:

1. A carton having a tear strip opening comprising:

a plurality of wall panels with at least one of said wall panels including an inner layer and an outer layer each being hingedly connected to a respective wall panel by way of a fold line;

a cut score line of weakness formed in an inner side of said outer layer cut a predetermined depth into said outer layer extending substantially the entire length of said outer layer and substantially parallel to said fold line and spaced inwardly towards said fold line from a free edge of said outer layer;

a second line of weakness formed in said outer layer extending substantially the entire length of said outer layer and substantially parallel to said fold line and spaced inwardly from said cut score line of weakness, said cut score line of weakness and said second line of weakness defining a tear strip; and an adhesive region formed on said inner side of said outer layer defined by said free edge and said cut score line;

wherein said second line of weakness ruptures and a ply separation occurs in said outer layer between said cut score line of weakness and said free edge in response to an opening force being applied to said tear strip.

2. The carton is defined in claim 1, wherein said second line of weakness is formed of a plurality of linearly positioned, substantially uniformly spaced through cuts.

3. The carton as defined in claim 2, wherein said through cuts are herringbone type through cuts.

4. The carton was defined in claim 1, further comprising a means for initiating said ply separation in response to said opening force.

5. The carton as defined in claim 4, wherein a leading portion of said tear strip includes a lift tab having a leading edge substantially collinear with an edge of said outer layer extending between said fold line and said second line of weakness, and a pair of diverging side edges with a first diverging side edge extending from a first end of said leading edge to said second line of weakness and a second diverging side edge extending from a second end of said leading edge to a point intermediate said cut score line of weakness and said free edge, and said means for initiating said ply separation is created by an oblique angle formed between said second side edge and said cut score line of weakness in said adhesive region.

6. The carton as defined in claim 1, wherein said predetermined depth is approximately 50% of the thickness of said outer layer.

7. A carton having a tear strip opening comprising:

a plurality of wall panels with at least one of said wall panels including an inner layer and an outer layer each being hingedly connected to a respective wall panel by way of a fold line;

a cut score line of weakness formed in an inner side of said outer layer cut a predetermined depth into said outer layer extending substantially the entire length of said outer layer and substantially parallel to said fold line and spaced inwardly towards said fold line from a free edge of said outer layer;

a second line of weakness formed in said outer layer extending substantially the entire length of said outer layer and substantially parallel to said fold line and spaced inwardly from said cut score line of weakness, said cut score line of weakness and said second line of weakness defining a tear strip;

an adhesive region formed on said inner side of said outer layer defined by said free edge and said cut score line; and a means for initiating a ply separation between said cut score line of weakness and said free edge;

wherein said second line of weakness ruptures and said ply separation occurs in said outer layer between said cut score line of weakness and said free edge in response to an opening force being applied to said means for initiating ply separation.

8. The carton is defined in claim 7, wherein said second line of weakness is formed of a plurality of linearly positioned, substantially uniformly spaced through cuts.

9. The carton as defined in claim 8, wherein said through cuts are herringbone type through cuts.

10. The carton as defined in claim 7, wherein a leading portion of said tear strip includes a lift tab having a leading edge substantially collinear with an edge of said outer layer extending between said fold line and said second line of weakness, and a pair of diverging side edges with a first diverging side edge extending from a first end of said leading edge to said second line of weakness and a second diverging side edge extending from a second end of said leading edge to a point intermediate said cut score line of weakness and said free edge, and said means for initiating said ply separation is created by an oblique angle formed between said second side edge and said cut score line of weakness in said adhesive region.

11. The carton as defined in claim 7, wherein said predetermined depth is approximately 50% of the thickness of said outer layer.

12. A blank having an inner and outer side for forming a carton including a tear strip opening, comprising:

a first main panel having a first plurality of side panels hingedly connected thereto by way of fold lines;

a second main panel having a second plurality of side panels hingedly connected thereto by way of fold lines with one of said first plurality of side panels and one of said second plurality of side panels being shared by said main panels;

a cut score line of weakness formed in the inner side of a selected one of said first and second plurality of side panels cut a predetermined depth into said blank and extending substantially the entire length of said selected side panel substantially parallel to said fold line and spaced from a free edge of said selected side panel toward said fold line;

a second line of weakness formed in said selected side panel extending substantially the entire length of said selected side panel substantially parallel to said fold line and spaced from said cut score line of weakness toward said fold line, said cut score line of weakness and said second line of weakness defining a tear strip; and adhesive region on said inner side of said selected side panel defined by said free edge and said cut score line.

13. The blank as defined in claim 12, wherein said predetermined depth is approximately 50% of the thickness of said selected side panel.

14. The carton as defined in claim 12, wherein said second line of weakness is formed of a plurality of linearly positioned, substantially uniformly spaced through cuts.

15. The carton as defined in claim 14, wherein said through cuts are herringbone type through cuts.

16. The carton as defined in claim 12, further comprising a means for initiating a ply separation in a carton formed of said blank in response to an opening force.

17. The carton as defined in claim 16, wherein a leading portion of said tear strip includes a lift tab having a leading edge substantially collinear with an edge of said outer layer extending between said fold line and said second line of weakness, and a pair of diverging side edges with a first diverging side edge extending from a first end of said leading edge to said second line of weakness and a second diverging side edge extending from a second end of said leading edge to a point intermediate said cut score line of weakness and said free edge, and said means for initiating said ply separation is created by an oblique angle formed between said second side edge and said cut score line of weakness in said adhesive region.

* * * * *